US006354184B1

(12) United States Patent
Hansen et al.

(10) Patent No.: US 6,354,184 B1
(45) Date of Patent: Mar. 12, 2002

(54) POWER MACHINE WITH VALVE MOUNT FOR VALVE ASSEMBLY

(76) Inventors: Ron Hansen, 15617-57th St., SE., Walcott, ND (US) 58077; Scott B. Jacobson, 16395 - 51st St. SE., Kindred, ND (US) 58051

( * ) Notice: Subject to any disclaimer, the term of this patent is extended or adjusted under 35 U.S.C. 154(b) by 0 days.

(21) Appl. No.: 09/396,812

(22) Filed: Sep. 14, 1999

(51) Int. Cl.[7] ..... F15B 11/08
(52) U.S. Cl. ..... 91/418; 91/459
(58) Field of Search ..... 91/418, 459; 137/625.65; 251/129.11

(56) References Cited

U.S. PATENT DOCUMENTS

| | | | | |
|---|---|---|---|---|
| 3,899,003 A | | 8/1975 | Tirelli | 137/625.65 |
| 4,526,342 A | | 7/1985 | Wakefield | 251/131 |
| 5,007,459 A | | 4/1991 | Asaoka | 137/625.65 |
| 5,035,264 A | | 7/1991 | Amico et al. | 137/625.65 |
| H1191 H | | 6/1993 | Hutchison et al. | 91/459 |
| 5,485,869 A | * | 1/1996 | Haynes | 137/625.65 |
| 5,579,807 A | * | 12/1996 | Kohler | 137/625.65 |
| 5,722,460 A | | 3/1998 | Olsen et al. | 137/625.65 |
| 5,778,932 A | * | 7/1998 | Alexander | 137/625.65 |

FOREIGN PATENT DOCUMENTS

| | | |
|---|---|---|
| FR | 1458177 | 12/1965 |
| GB | 1093494 | 7/1964 |
| WO | WO 93/18327 | 9/1993 |

* cited by examiner

*Primary Examiner*—Hoang Nguyen

(57) ABSTRACT

A power machine or a skid steer loader that is driven by an engine and has hydraulic pump, hydraulic fluid conduit, a hydraulic motor in fluid communication with a hydraulic fluid conduit and a valve that is operated or actuated by linear actuator such that the linear actuator is mounted directly on the valve block.

16 Claims, 6 Drawing Sheets

POWER MACHINE WITH VALVE MOUNT FOR VALVE ASSEMBLY

BACKGROUND OF THE INVENTION

The present invention generally relates to valve mountings for hydraulic systems in power machines. In particular, the present invention relates to the direct mounting of valve actuators on valve blocks.

Machines such as skid steer loaders and other power machines employing conventional hydraulic systems need valves for their operation. These valves utilize linear actuation mechanisms. Currently, linear actuators are not directly mounted on the valve surface, but instead, they are mounted on a separate portion of the system such as a support plate. The sliding plunger of the actuator is connected to the spool of the valve. Since the linear actuator is positioned separate from the valve, the sliding plunger and the portion of the valve spool extending from the valve block have to be covered by a sealed rubber boot in order to prevent penetration by any dust from the exterior.

The separation of the actuator and the valve poses several problems in conventional systems. Some of the problems include:

1. The rubber boot provides limited protection from dirt, but over a period of time dirt penetrates into the area surrounding the plunger and the exterior of the spool.

2. The plunger may not be aligned with the spool, thereby resulting in reduced efficiency as a result of all the force not acting in a linear direction.

3. The valve and the actuator have separate tolerances due to being spaced apart.

4. The center line of the plunger is offset from the center line of the spool resulting in a possibility of an induced moment.

5. Mounting of the actuator on the support plate prevents rotation of the motor about the axis of the plunger and thereby does not provide for good clearance of other parts.

SUMMARY OF THE INVENTION

The valve assembly of the present invention utilizes a linear actuator that is mounted directly on the valve block around an exterior projection of the valve spool. The direct mounting of the actuator on the valve block provides a substantially air tight mounting for the valve assembly.

Direct mounting of the actuator on the valve block can be efficiently utilized in machines such as skid steer loaders and other power machines that employ hydraulic circuits for their operation.

An illustrative embodiment of the valve assembly has an actuator which has a sleeve with an internal plunger that can be moved within the sleeve. One end of the sleeve has an actuator motor that drives the plunger and the other end of the sleeve has a flange. The sleeve also has a collar with a pair of bores through which screws can be passed to bolt the sleeve rigidly to the valve mount. A retainer seal with a cylindrical groove and a pair of bolt holes provides an interface between the actuator sleeve and the valve block. The retainer seal also has a grooved portion called the O-ring groove which is dimensioned to receive the flange on the sleeve such that an air tight coupling is made between the sleeve and the retainer seal.

Therefore, one embodiment of the invention provides a direct and rigid coupling between the linear actuator and the valve block.

An embodiment of the invention also provides a direct coupling between the linear actuator and the valve surface which is sufficiently tight so that dirt is prevented from penetrating into the valve bore.

An embodiment of the invention further provides and maintains a linear connection between the plunger and the spool at all times.

A further aspect of the invention prevents the pin connection between the plunger and the spool from slipping by always maintaining the pin within a cylindrical portion.

These embodiments and aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE ILLUSTRATIVE EMBODIMENTS

The following detailed description should be read with reference to the drawings in which like elements in different drawings are numbered the same. The drawings, which are not necessarily to scale, depict selected embodiments and are not intended to limit the scope of the invention.

Figure 1:
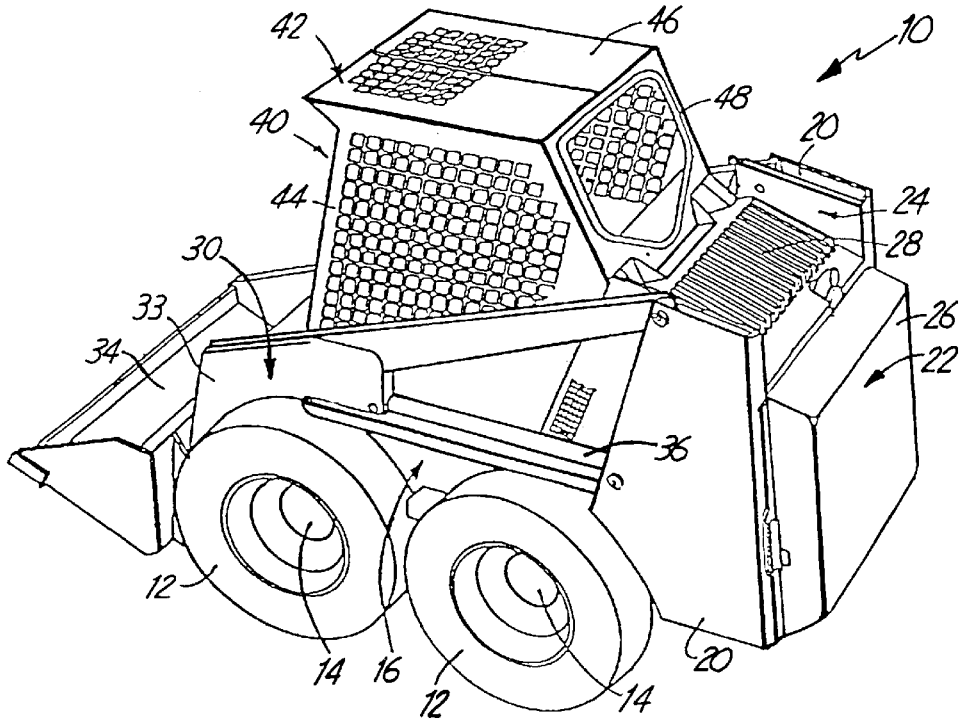
FIG. 1 is a perspective view illustrating the side and rear of a skid steer loader that utilizes the valve assembly of the present invention.
Figure 2:
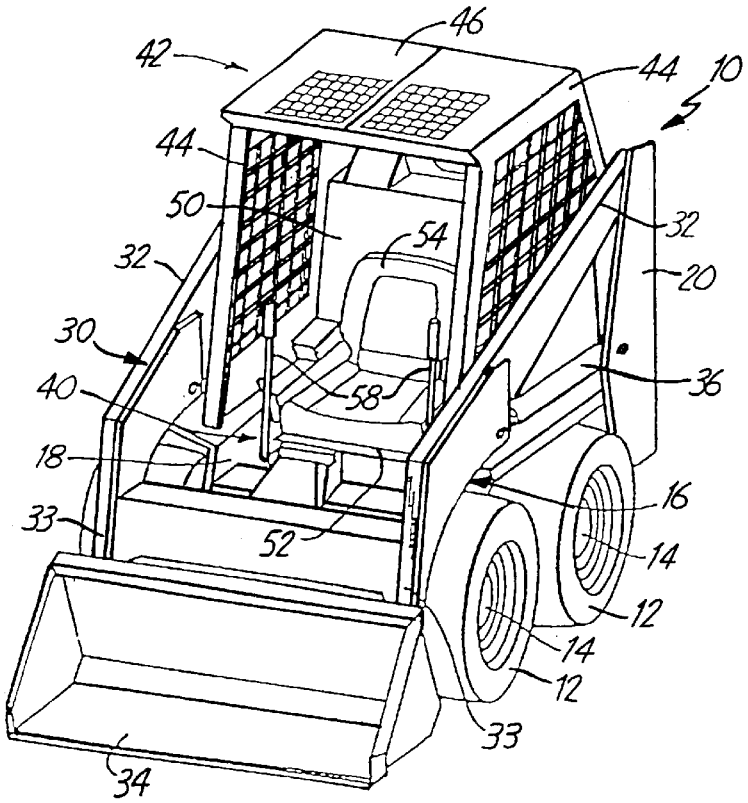
FIG. 2 is a perspective view illustrating the front and side of a skid steer loader.

FIGS. 1 and 2 illustrate perspective views of a skid steer loader 10 which can be used with the present invention. Skid steer loader 10 includes a mainframe assembly 16, a lift arm assembly 30, and an operator's compartment 40. An engine compartment 22 and a heat exchanger compartment 24 are illustratively located at the rear of the skid steer loader 10. Two pairs of wheels 12 are mounted to stub axles 14 and extend from both sides of the mainframe 16.

Lift arm assembly 30 is mounted to upright members 20 of the mainframe assembly 16. Lift arm assembly 30 includes an upper portion formed by a pair of lift arms 32 which extend over wheels 12 and are pivotally mounted at a rear end to upright members 20. The front end of lift arms 32 are connected to a lower potion 33 which is pivotally attached to a tool (such as a bucket) 34. Lift arm assembly 30 is raised and lowered with respect to the mainframe assembly 16 by a pair of lift cylinders 36. Each of the lift cylinders 36 includes a first end pivotally mounted to upright member 20 and a second end pivotally mounted to lift arm 32. Bucket 34 is pivoted with respect to lift arm 32 by means of a bucket tilt cylinder (not shown).

Operator compartment 40 is partially enclosed by a cab 42 which includes side guard panels 44, overhead panel 46, rear guard panel 48, back panel 50 and seat pan 52. Cab 42 illustratively and optionally acts as an integral unit which is pivotally mounted at its rear to mainframe 16. With this arrangement, the entire cab, including seat 54, may be pivoted upwardly and toward the rear of the loader 10 in order to permit access to the engine compartment 22 in addition to other mechanical and hydraulic systems of the skid steer loader 10.

All functions of the skid steer loader 10 may be controlled by an operator who illustratively sits in the operator's compartment 40. The hydraulic drive system, which is described in more detail hereinafter, may be controlled using a pair of steering levers 58, one on each side of the seat. Each of the levers 58 may be moved independently in a forward and rearward direction. Movement of the levers 58 cause the wheels 12 on the corresponding side of the loader to rotate at a speed and in a direction corresponding to the extent and direction in which the respective lever 58 is moved. For example, if the left hand lever is moved in the forward direction, the left hand wheels 12 rotate in the forward direction at a speed corresponding to the distance the lever 58 has been moved. The left cylinder 36 and the bucket tilt cylinder (not shown) are actuated by means of foot pedals (not shown) or operator inputs on handles or hand grips on steering levers 58 or on a dash mounted toward the front of the operator's compartment 40. These and other aspects of the operation of the skid steer loader 10 are known to those skilled in the art.

Figure 3:
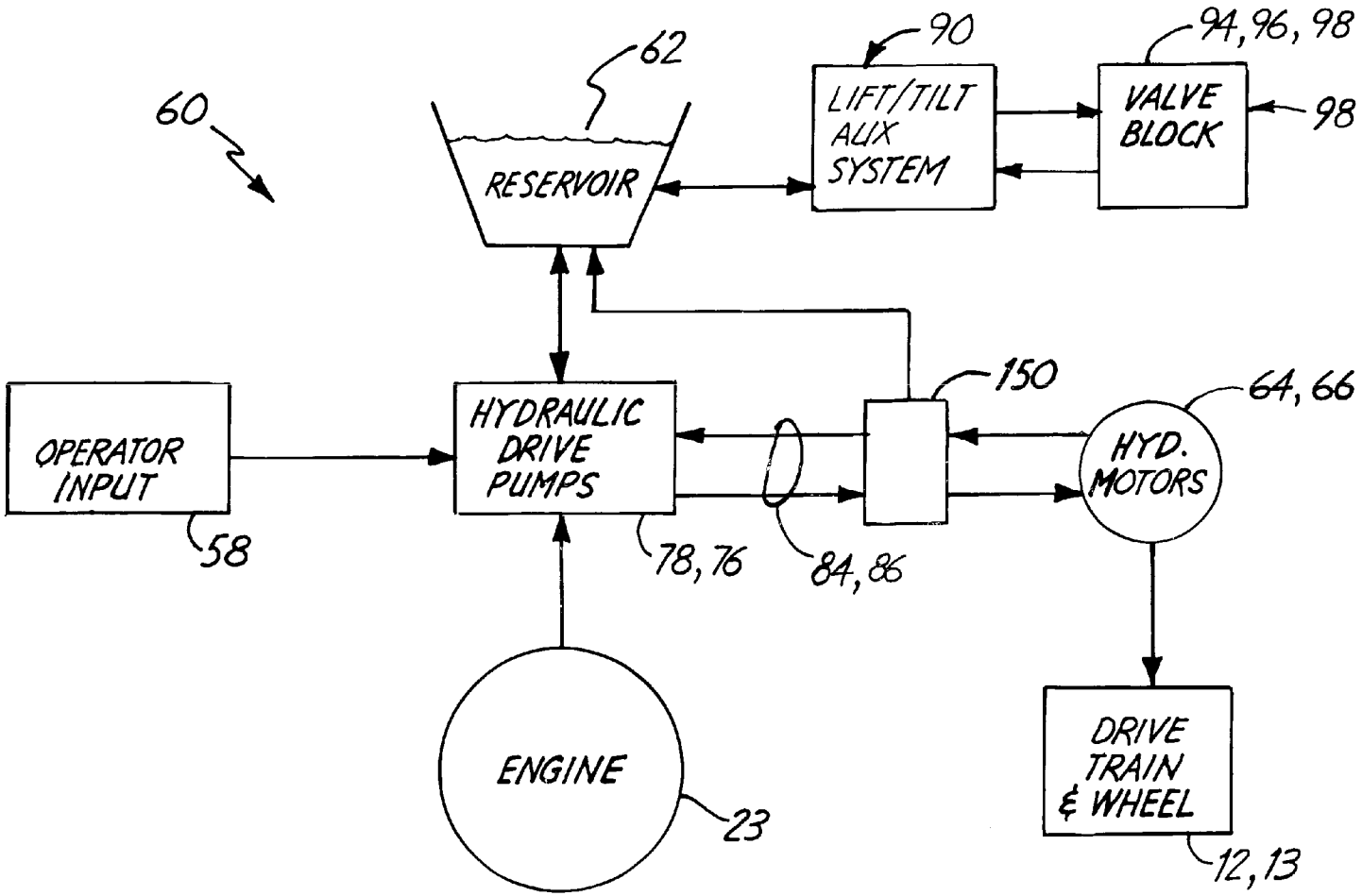
FIG. 3 is a functional diagram of a typical hydraulic system that can utilize valve assemblies of the present invention.

FIG. 3 illustrates a functional diagram of a conventional hydrostatic drive system 60. Hydrostatic drive system 60 includes left and right hydraulic drive pumps (illustrated by block 76, 78 in FIG. 3) driven by engine 21 and controlled by operator inputs 58. Hydraulic drive pumps 76, 78 are coupled to left and right hydraulic motors (illustrated by numerals 64, 66 in FIG. 3) by way of hydraulic loops (illustrated by numerals 84, 86 in FIG. 3) which pass through flushing valve 150. The hydraulic motors 64, 66 are coupled to a wheel 12 by way of a drive train 13. Wheel 12 and drive train 13 are shown collectively as 12, 13 in FIG. 3. Operator input mechanisms 58 are individually coupled by linkages (not shown) to valves associated with left motor pump 76 and right motor pump 78. The direction and extent to which the operator input mechanisms 58 are moved directly affects the direction and volume of hydraulic fluid provided to drive motors 64 and 66 and therefore the direction and speed at which the loader 10 is driven. A relatively high pressure is typically encountered when the hydraulic motors 64, 66 are driven at relatively high speed. When the pressure in the hydraulic loops 84, 86 reaches a threshold high pressure, the flushing valve 150 exhausts oil to reservoir 62.

The hydraulic system of FIG. 3 also includes a hydraulic circuit 90 that has an auxiliary pump that is coupled to the lift cylinder 36 (shown in FIGS. 1 and 2), tilt cylinder and auxiliary ports. A valve block 92 for hydraulic circuit 90 includes a tilt valve 94, lift valve 96 and auxiliary valve 98 interconnected in the hydraulic circuit. Valve block 92 can either be integrally formed or formed by discretely mounted valves. Valves 94, 96 and 98 can be implemented using electrically actuated spool valves or manually actuated spool valves coupled by linkages, which may be mechanical or electrical linkages to an operator input device such as a foot pedal located in the front of the operator compartment 40 or a hand control illustratively located on a handgrip on one of the levers, 58.

Figure 4:
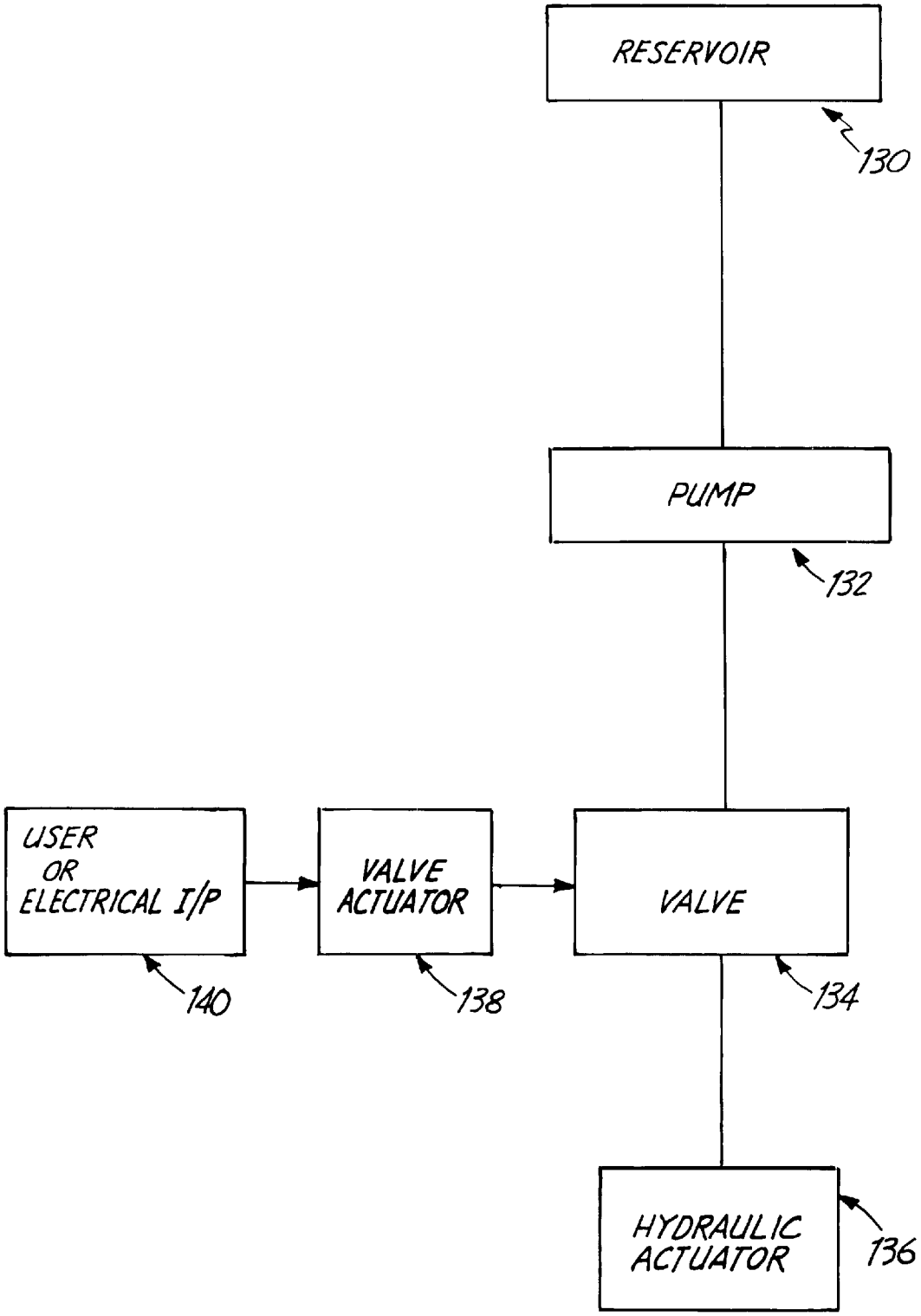
FIG. 4 is a block diagram of a hydraulic system which can utilize valve assemblies of the present invention.

FIG. 4 is a block diagram of a hydraulic system similar to that of FIG. 3, and in addition, showing a valve actuator 138 for valve 134 (which is illustratively one of the valves mounted in valve block 92). Fluid is provided under pressure by pump 132 to valve 134. Movement of the hydraulic actuator 136 (which can be a linear motor such as a cylinder or rotary hydraulic motor or any other desired motor) can be controlled by adjusting the state of valve 134 to either block or conduct pressurized fluid. Valve adjustment is controlled by user or electrical input 140 to a valve actuator 138, which in turn causes movement of a valve spool that controls the passage of fluid through the valve 134.

Figure 5:
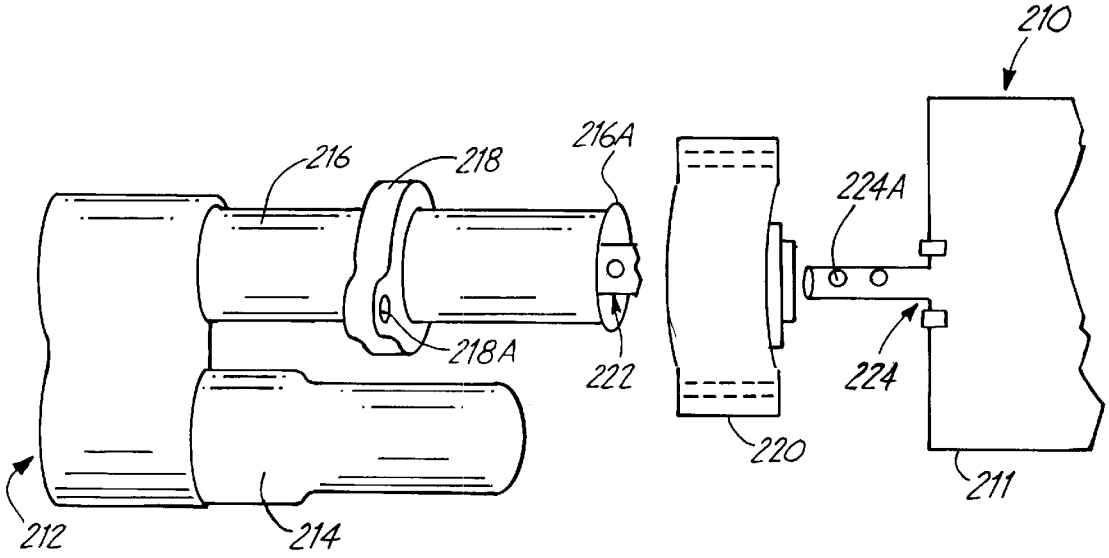
FIG. 5 is a perspective view illustrating pertinent individual parts that form one embodiment of the valve assembly of the present invention.
Figure 6B:
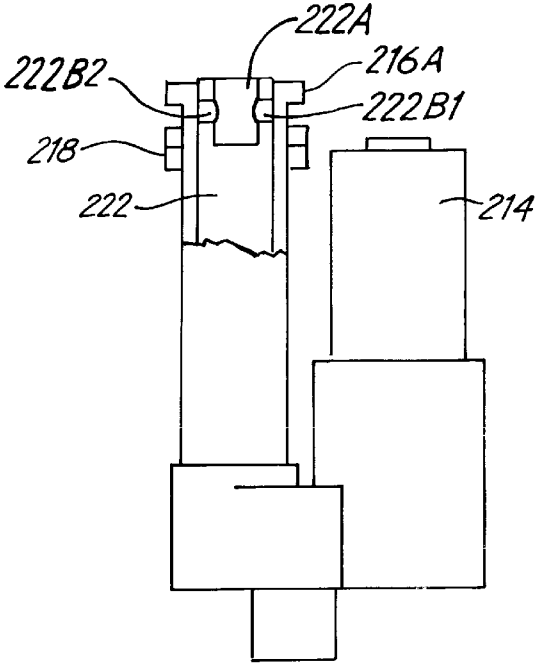
FIG. 6B shows details of the end of the linear actuator that is connected to the valve mount.
Figure 6A:
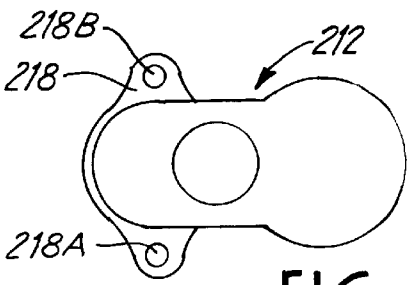
FIG. 6A is a top view of the motor connection end of the linear actuator for one embodiment of the valve assembly.
Figure 6C:
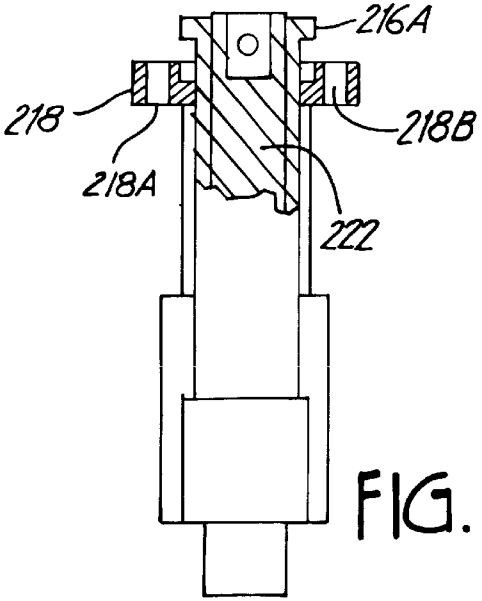
FIGS. 6C and 6D also show details of the end of the linear actuator that is connected to the valve mount.
Figure 6D:
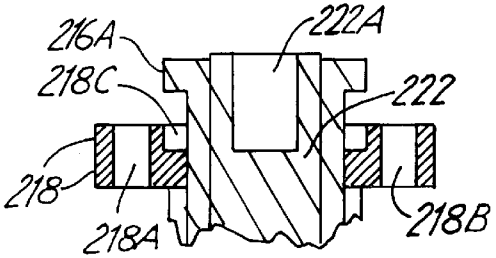

FIG. 5 illustrates a basic layout of an illustrative embodiment of the present invention. Valve 210 (which can correspond to valve 134 in FIG. 4) includes a housing 211 which defines a bore, a fluid inlet and a fluid outlet. Valve 210 also has spool 224 slidably received within the bore with a portion of the spool 224 projecting outside the surface of the valve housing 211.

Actuator 212 (which can correspond to actuator 138 in FIG. 4) is directly coupled to the projection of spool 224. Actuator 212 has a motor 214 that drives a plunger 222 which is housed within a sleeve 216. The plunger 222 is connected to motor 214 at one end and to spool 224 of the valve 210 at the other end. Operation of valve 210 will now be described with the help of FIGS. 4 and 5.

User or electrical input to operate the hydraulic actuator 136 (shown in FIG. 4) is translated to a signal whose magnitude and direction corresponds to a selection made by the user or operator. This signal is applied to motor 214 of actuator 212. Based on this signal, motor 214 drives plunger 222 within sleeve 216 forward or backward along a longitudinal axis. Since plunger 222 is directly coupled to spool 224, and both plunger 222 and spool 224 are along the same longitudinal axis, movement of the plunger 222 results in a corresponding extension or withdrawal of spool 224 within the base (not shown) of valve housing 211. Movement of the spool 224 within the bore causes partial or complete opening/closing of the fluid inlet and outlet in valve 210. Control of the opening or closing of the fluid inlet and outlet of the valve 210 controls the flow rate and volume of pressurized fluid that is communicated to the hydraulic actuator 136 from pump 132, thereby providing for effective operation of the hydraulic actuator 136.

Sleeve 216 (shown in FIG. 5) has a collar 218 slidably disposed on its outer surface. Collar 218 is used to clamp the actuator 212 to the valve block or housing 211. FIG. 5 also shows retainer seal 220 which forms an interface between the actuator 212 and the valve block or housing 211. In an assembled condition, the actuator 212 and retainer seal 220 form a direct and fluid tight or air tight coupling for the valve 210 and actuator 212.

Figure 7A:
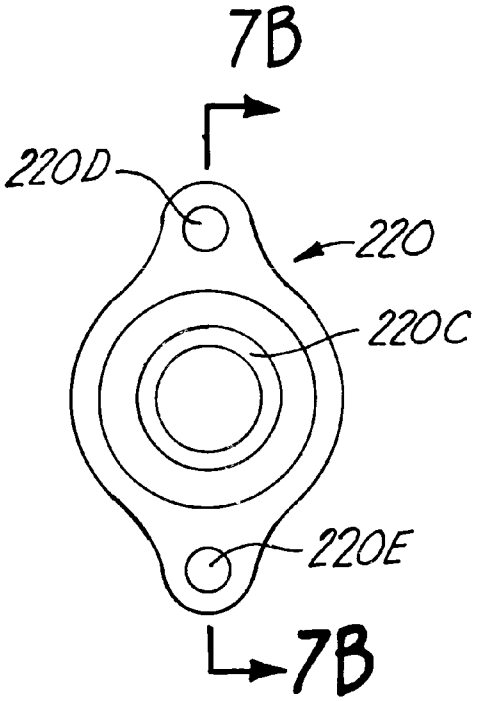
FIG. 7A is a top view of the retainer seal looking down at the end of the retainer seal that fits into the valve surface.
Figure 7B:
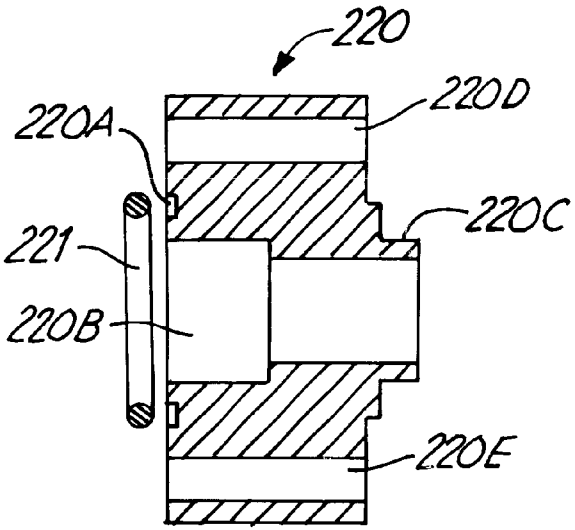
FIG. 7B shows details of the retainer seal.

FIGS. 6A–6D show details of the end of the actuator 212 that is connected to the spool 224 of valve 210. FIGS. 7A and 7B show details of the retainer seal 220. These figures will now be described in conjunction with one another.

The portion of the plunger 222 that is connected to the spool 224 has a recess 222A which is sized to receive the end of the spool 224. The recess portion 222A of the plunger 222 has identically sized opposing hollow cylindrical grooves 222B1 and 222B2. A cylindrical groove 224A of diameter substantially equal to the diameters of grooves 222B1 and 222B2 passes through extended position of spool 224 that fits into recess 222A. When groove 224A is positioned within recess 222A and aligned with grooves 222B1 and 222B2, a pin can be passed through these grooves to hold plunger 222 and spool 224 together. The pin is always held in position because it is always situated within a cylinder when the apparatus is assembled.

The sleeve 216 has a flange 216A radially sized to fit into an O-ring groove 220A on the retainer seal 220. By fitting the flange 216A into the O-ring groove 220A, which also has an O-ring 221 disposed therein, effective protection from dirt at the junction of the plunger and the spool is provided.

The collar 218 has bores 218A and 218B and retainer seal 220 also has bores 220D and 220E of a substantially similar size as collar bores 218A and 218B such that screws can be passed through their bores to connect the actuator 212 to the valve housing 211 via the retainer seal 220. The collar 218 also has a recess 218C (shown in FIG. 6D) that is dimensioned to fit around flange 216A when the collar 218 and retainer seal 220 are bolted to the valve block or housing 211. The retainer seal 220 also has a projection 220C that fits into valve block or housing 211 to provide additional stability for the valve assembly.

Direct assembly of the actuator 212 on the valve block or housing 211 can be easily accomplished by first passing the retainer seal 220 over the projecting end of the spool 224 and then inserting the end of actuator 212 that has flange 216A and plunger recess 222A into the retainer seal 220. The extending end of spool 224 is then positioned in recess 222A to align recess grooves 222B1 and 222B2 and spool groove 224A. A pin is snapped into these grooves to hold the spool 224 and plunger 222 together. Flange 216A is then fitted into O-ring groove 220A that has an O-ring 221 therein. Collar 218 is then closely positioned against retainer seal 220 with portion of the flange 216A that is outside the O-ring groove 220A fitting into collar recess 218C. Collar bores 218A and 218B are aligned with retainer seal bores 220D and 220E. Screws are then passed into these bores and tightened into valve block or housing 211. This completes a structurally simple and easily mountable valve assembly.

It should also be noted that retainer (or spacer) 220 can be formed in a wide variety of different ways. For example, the machined O-ring groove 220A can be eliminated so the parts simply contact one another in a face-to-face (or other) manner. Similarly, projection 220C can be eliminated, or provided on valve block or housing 211 rather than on retainer 220. Other changes can be made to retainer 220, or other parts, as well.

Although the present invention has been described with reference to preferred embodiments, workers skilled in the art will recognize that changes may be made in form and detail without departing from the spirit and scope of the invention.

What is claimed is:

1. A valve assembly for a hydraulic valve actuator used in a skid steer loader, the valve assembly comprising:

a valve that includes a valve housing having a bore, a fluid inlet and a fluid outlet;

a spool slidably received within the bore, the spool having an outer end;

a linear actuator that includes a hollow cylindrical sleeve, a plunger slidably arranged within the hollow cylindrical sleeve and connectable to the outer end of the spool, and a motor operably coupled to the plunger;

a collar disposed on the hollow cylindrical sleeve;

a retainer seal having an actuator end that is spaced apart from a valve end, and also having a groove extending through the retainer seal from the actuator end to the valve end, such that the retainer seal forms an interface between the linear actuator and the valve that is sufficient to space the linear actuator from the valve while inhibiting dirt penetration into an interior thereof; and a bolt path defined by the collar, the retainer seal, and the valve, the bolt path being configured to receive a bolt that secures the linear actuator, the retainer seal and the valve firmly together.

2. The valve assembly of claim 1, wherein the motor is positioned at a first end of the hollow cylindrical sleeve.

3. The valve assembly of claim 2, wherein the plunger is connected to the outer end of the spool at a second end of the hollow cylindrical sleeve.

4. The valve assembly of claim 1, wherein the plunger defines a recess that receives the outer end of the spool.

5. The valve assembly of claim 4, wherein the spool is connected to the plunger within the recess with a pin.

6. The valve assembly of claim 1, wherein the collar is slidably positioned on the hollow cylindrical sleeve to facilitate clamping of the linear actuator to the actuator end of the retainer seal.

7. The valve assembly of claim 6, wherein the collar defines a plurality of collar bores that are a portion of the bolt path and are configured to receive bolts.

8. The valve assembly of claim 7, wherein the retainer seal defines a plurality of retainer seal bores aligned with the plurality of collar bores on the collar, the plurality of retainer seal bores being a portion of the bolt path and being configured to receive bolts.

9. The valve assembly of claim 8, wherein the collar, the retainer seal and the valve housing are connected via a plurality of bolts that pass through the collar bores and the retainer seal bores into bores formed in the valve housing.

10. The valve assembly of claim 6, wherein the sleeve further comprises a flange positioned between the collar and the retainer seal.

11. The valve assembly of claim 10, wherein the retainer seal has an O-ring groove and an O-ring deposited therein, such that the flange abuts the O-ring to form a substantially fluid tight connection inhibiting dirt from penetrating into the junction of the plunger and the spool.

12. A skid steer loader comprising:

an engine;

a hydraulic drive pump coupled to and driven by the engine;

a hydraulic fluid conduit in fluid communication with the hydraulic drive pump;

a hydraulic motor in fluid communication with the hydraulic fluid conduit;

a valve that is in fluid communication with the hydraulic fluid conduit; and a linear actuator operably disposed relative to the valve and having a flange positioned on one end of a cylindrical sleeve; and a retainer seal forming a connection interface between the linear actuator and the valve, the retainer seal having a valve end that is spaced apart from an actuator end that is configured to receive the flange, the entire retainer seal being configured to enable a connection that spaces the linear actuator from the valve while at the same time forming an effective fluid tight interface there between.

13. The skid steer loader of claim 12, wherein the retainer seal has an O-ring groove and an O-ring disposed therein, such that the flange abuts the O-ring to form a substantially fluid tight connection between the linear actuator and the valve housing.

14. A power machine comprising:

an engine;

a hydraulic drive pump coupled to and driven by the engine;

a hydraulic fluid conduit in fluid communication with the hydraulic drive pump;

a hydraulic motor in fluid communication with the hydraulic fluid conduit;

a valve that is in fluid communication with the hydraulic fluid conduit;

a linear actuator operably disposed relative to the valve;

a collar disposed on the linear actuator;

a retainer seal forming a connection interface between the linear actuator and the valve, the retainer seal having a valve end that is spaced apart from an actuator end, the retainer seal being configured to enable a connection that spaces the linear actuator from the valve while at the same time forming an effective fluid tight interface there between; and a bolt path defined by the collar, the retainer seal, and the valve, the bolt path being configured to receive a bolt that secures the linear actuator, the retainer seal and the valve firmly together.

15. The power machine of claim 14, further comprising:

a sleeve for the linear actuator, the sleeve having a retainer seal end;

a flange positioned at the retainer seal end of the sleeve; and an O-ring groove in the retainer seal, and an O-ring disposed therein, such that the flange abuts the O-ring to form a substantially fluid tight connection between the linear actuator and the valve housing.

16. The power machine of claim 15, wherein the hydraulic motor is selected from a group consisting of a rotary motor, a linear motor, a lift cylinder, a tilt cylinder and an auxiliary coupler.

* * * * *

UNITED STATES PATENT AND TRADEMARK OFFICE
Certificate

Patent No. 6,354,184 B1 Patented: March 12, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Ron Hansen, Walcott, ND; Scott B. Jacobson, Kindred, ND; William C. Shelbourn, Bismarck, ND; Robert J. Celley, Bismarck, ND; and Randy Entzi, Bismarck, ND.

Signed and Sealed this Eighth Day of July 2003.

THOMAS E. DENION
*Supervisory Patent Examiner*
Art Unit 3748